US012599948B2

(12) United States Patent
Ritter et al.

(10) Patent No.: US 12,599,948 B2
(45) Date of Patent: Apr. 14, 2026

(54) METHOD AND COMPUTER PROGRAM PRODUCT FOR CALCULATING A PASS SCHEDULE FOR A STABLE ROLLING PROCESS

(71) Applicant: SMS group GmbH, Düsseldorf (DE)

(72) Inventors: Andreas Ritter, Haiger (DE); Rainer Merz, Kreuztal (DE)

(73) Assignee: SMS group GmbH, Düsseldorf (DE)

( * ) Notice: Subject to any disclaimer, the term of this patent is extended or adjusted under 35 U.S.C. 154(b) by 322 days.

(21) Appl. No.: 18/015,099

(22) PCT Filed: Jul. 6, 2021

(86) PCT No.: PCT/EP2021/068604
§ 371 (c)(1),
(2) Date: Jan. 9, 2023

(87) PCT Pub. No.: WO2022/008486
PCT Pub. Date: Jan. 13, 2022

(65) Prior Publication Data

US 2023/0249234 A1 Aug. 10, 2023

(30) Foreign Application Priority Data

Jul. 9, 2020 (DE) ..... 10 2020 208 633.8

(51) Int. Cl.

| | |
|---|---|
| ***B21B 37/58*** | (2006.01) |
| ***B21B 37/16*** | (2006.01) |
| ***B21B 37/46*** | (2006.01) |
| ***B21B 37/74*** | (2006.01) |

(52) U.S. Cl.
CPC ..... *B21B 37/58* (2013.01); *B21B 37/16* (2013.01); *B21B 37/46* (2013.01); *B21B 37/74* (2013.01)

(58) Field of Classification Search
CPC ..... B21B 13/145; B21B 37/16; B21B 37/46; B21B 37/58; B21B 37/74; B21B 2031/206
See application file for complete search history.

(56) References Cited

U.S. PATENT DOCUMENTS 4,531,394 A * 7/1985 Turley ..... B21B 13/145 72/243.4
5,722,279 A 3/1998 Ogawa et al.
(Continued)

FOREIGN PATENT DOCUMENTS

EP 0159796 A1 10/1985
EP 1514616 A1 3/2005
(Continued)

OTHER PUBLICATIONS

CN 105880299A, Chen et al. Aug. 2016.*
(Continued)

*Primary Examiner* — Edward T Tolan
(74) *Attorney, Agent, or Firm* — Smartpat PLC

(57) ABSTRACT

A method and a corresponding computer program product calculate a pass schedule for a stable rolling process when rolling metal strip in a rolling mill. The offset here is varied until the calculated target horizontal force satisfies a predefined limit criterion. The satisfaction of the limit criterion means that the set of rolls and the rolling process are stable. For cases in which a sole iteration of the offset of the working roll does not result in the limit criterion being satisfied, the present invention provides that the draws on the material to be rolled are then changed on the feed side and/or on the outlet side of the rolling stand with constant offset until the calculated target horizontal force satisfies the limit criterion.

12 Claims, 9 Drawing Sheets

(56) References Cited

U.S. PATENT DOCUMENTS

| | | | | |
|---|---|---|---|---|
| 8,261,906 | B2 * | 9/2012 | Nakano | C08L 7/00 198/846 |
| 10,421,106 | B2 * | 9/2019 | Norikura | B21B 13/14 |
| 2001/0018840 | A1 * | 9/2001 | Nihei | B21B 13/145 72/243.4 |
| 2002/0108423 | A1 * | 8/2002 | Nakayama | B21B 1/24 72/234 |

FOREIGN PATENT DOCUMENTS

| | | | |
|---|---|---|---|
| EP | 2464470 | A1 | 2/2011 |
| JP | H10314808 | A | 12/1998 |
| WO | 2018177827 | A1 | 10/2018 |

OTHER PUBLICATIONS

Translation CN 105880299A, Chen et al. Aug. 2016.*
EP 1514616A1, Biedermann et al. Mar. 2005.*
JP 05-177217A, Watanabe et al. Jul. 1993.*
JP 07-100165B2, Nakajima et al. Nov. 1995.*
Kasai, S., Y. Takakura, K. Yasuda, and T. Hatanaka. "Universal Crown Control Mill for fine steel (UC1F-MILL)." Hitachi review 45, No. 6 (1996): 279-282.
Wolfgang Rohde, Walzwerktechnik. Mitschrift der Vorlesung. Institut für Bildsame Formgebung. Rheinisch-Westfälische Technische Hochschule Aachen, Jan. 6, 2001.

* cited by examiner

WR330mm:C75,1162mm X 2,0mm an 0,793mm, permissible horizontal force (limit criterion material-dependent load limit) = 80KN

| Draw | FA [KN] | Raw [mm] | Rsw [mm] | saw [mm] | Ze [KN] | ZA [KN] | k=1 Haw Einfädeln [KN] | k=4 Haw Walzen [KN] | k=7 Haw Ausfädeln [KN] | Fbaw max [KN] | Haw mit Fbaw [KN] | Fres [KN] | |
|---|---|---|---|---|---|---|---|---|---|---|---|---|---|
| 1 | 15242 | 165 | 625 | -10 | 51,1 | 211,5 | 106,7 | 112,7 | 64,7 | 500 | 125,4 | 515,5 | |
| 2 | 15243 | 165 | 625 | -8 | 51,1 | 211,5 | 87,4 | 74,2 | 45,5 | 500 | 84,3 | 507,1 | |
| 3 | 15244 | 165 | 625 | -6 | 51,1 | 211,5 | 68,1 | 35,6 | 26,2 | 500 | 43,2 | 501,9 | HS-offset chosen - 6mm |
| 4 | 15245 | 165 | 625 | -4 | 51,1 | 211,5 | 48,8 | -3,0 | 6,9 | 500 | 2,1 | 500,0 | |
| 5 | 15246 | 165 | 625 | -2 | 51,1 | 211,5 | 29,5 | -41,6 | -12,4 | 500 | -39,1 | 501,5 | |
| 6 | 15247 | 165 | 625 | 0 | 51,1 | 211,5 | 10,2 | -80,2 | -80,2 | 500 | -80,2 | 506,4 | |
| 7 | 15248 | 165 | 625 | 2 | 51,1 | 211,5 | -9,1 | -118,8 | -118,8 | 500 | -121,3 | 514,5 | |
| 8 | 15249 | 165 | 625 | 4 | 51,1 | 211,5 | -28,4 | -157,4 | -157,4 | 500 | -162,5 | 525,7 | |
| 9 | 15250 | 165 | 625 | 6 | 51,1 | 211,5 | -47,7 | -196,0 | -196,0 | 500 | -203,6 | 539,9 | |
| 10 | 15251 | 165 | 625 | 8 | 51,1 | 211,5 | -67,0 | -234,6 | -234,6 | 500 | -244,8 | 556,7 | |
| 11 | 15252 | 165 | 625 | 10 | 51,1 | 211,5 | -86,3 | -273,3 | -273,3 | 500 | -285,9 | 576,0 | |

METHOD AND COMPUTER PROGRAM PRODUCT FOR CALCULATING A PASS SCHEDULE FOR A STABLE ROLLING PROCESS

TECHNICAL FIELD

The disclosure relates to a method and a corresponding computer program product for calculating a pass schedule for a stable rolling process when rolling metal strip in a rolling mill.

BACKGROUND

In the flat rolling of a material to be rolled, in particular metallic strips, it is well known that small working roll diameters must be provided to achieve small final thicknesses (or for reasons of energy efficiency). However, small working roll diameters limit the possible geometry of the drive journal and thus the possible drive torque, which is comparably greater with increased material strength/increased forming resistance.

SUMMARY

A disadvantage of using small working roll diameters when rolling metal strips is the horizontal deflection of the rolls due to the acting horizontal force at a large slenderness ratio (ratio of bearing center distance to roll diameter); see FIG. 6. The horizontal deflection not only leads to instability of the entire set of rolls, it can even go so far as to cause the rolls to buckle. In the case of very small working rolls, the deflection may have not only a horizontal component, but also a vertical component in the direction of the roll supporting it. The deliberate vertical bending of the working rolls to set a roll gap contour is not relevant in this consideration.

Various measures for protecting and stabilizing thin rolls against horizontal deflection during a rolling operation are known in the prior art.

One of these measures is the so-called horizontal "offset." Thereby, the axial extension of a pair of working rolls is offset from the pair of rolls on which it is supported. An offset of 0 (zero) results in an unstable set of rolls and is generally avoided, since roll gap changes can cause the rolls to "wander" due to bearing play, resulting in strip defects and strip cracks.

A fixed offset is suitable for hot rolling mills, with which strip draws show little critical effect on roll gap conditions and the stability of the set of rolls. For cold rolling mills, in particular with large product ranges and/or upon a reversing operation and/or with non-driven working rolls, a fixed offset is not sufficient.

A further development of the fixed offset is the so-called HS (horizontal stabilization) offset, which is set by a HS shift (device). Thereby, HS shift means that the pair of working rolls, together with its chocks, is shifted in +/− strip running direction. Basically, this concerns a variable setting of an offset. The amount and direction of the HS offset are set such that the force components arising from the vertical setting force FA and offset (horizontal force), along with the resulting tensile difference from the feed and outlet draw Ze, Za compensate each other as far as possible, preferably almost completely, in all rolling phases and the roll nevertheless rests stably on one side of the roll supporting it. The side to be set can be either on the feed side (−) or on the outlet side (+), depending on the parameters, for example roll force, torque, roll diameter of both rolls, feed and outlet side strip draws. As a result, the horizontal forces minimized by the setting of the HS offset lead to only minimal horizontal deflection with absolutely stable roll position.

The setting force FA along with the draw on the feed side Ze and on the outlet side Za of the rolling stand are the main forces responsible for the forming work to be performed on the metal strip. The force component from the offset, that is, the horizontal force of the working rolls Haw is a resulting force that is obtained by vectorial addition arising from the other force components mentioned, wherein all force components together must vectorially add up to 0, as shown in FIG. 7. The horizontal force Haw and the offset have the following functional proportional relationship:

$$Haw=f(FA,-\text{saw},MA,Ze-Za,\mu,r)$$

with

MA drive torque

μ coefficient of friction; and r radius of the working roll, saw offset wherein the detailed, known calculations vary depending on the type of set of rolls and its drive.

Given that small-diameter working rolls in particular react particularly critically to excessive horizontal forces, for example by tending to exhibit undesirable horizontal deflection as shown in FIG. 6, it is important that the horizontal forces do not become too great when using working rolls with a high slenderness ratio. In the prior art, it is therefore known and common practice to calculate the target horizontal force on the working roll with the aid of a pass schedule calculator, on which a process model of the roll process is run. The pass schedule calculator calculates the horizontal force taking into account a variety of input data.

A clear illustration of the input data used by the pass schedule calculator to calculate the setup data, that is, the presetting for the rolling stand prior to the start of a rolling process, is shown in FIG. 8. It can be seen that the input data is system data, data on technological limits, material data, data on rolling strategy, bundle data, product data and/or optionally production planning data as well.

Input data traditionally also includes a predefined initial offset of the working roll, determined manually and stored in a database or table, relative to another roll in the rolling stand against which the working roll is supported.

In the prior art, the target horizontal force calculated on the basis of this input data is then checked to see whether it satisfies a predefined limit criterion during rolling under constant conditions. If so, the initial offset on which the calculation of the target horizontal force was based is set at the working roll and the material to be rolled is rolled. Based on the offset that has been set, it can then be assumed that the previously calculated target horizontal force, which satisfies the limit criterion, acts on the offset working roll. Compliance with the limit criterion is representative of a stable set of rolls and rolling process.

If the initially calculated target horizontal force does not satisfy the predefined limit criterion, in the prior art the calculation of the target horizontal force is repeated with a respectively changed offset of the working roll from a set of N available different offsets, but with otherwise unchanged input data, until it is determined that the last calculated target horizontal force, taking into account the last changed (optimal) offset, satisfies the limit criterion for the first time in the best possible manner.

This known method represents the closest prior art and is distinguished from the claimed invention. The known method is used to determine an optimal offset for the working roll at which the calculated target horizontal force lies within the limit criterion and therefore ensures stable rolling conditions.

In practice, it has been shown that the calculation of the target horizontal force by iteration of the offset alone, with the input data otherwise kept constant, in particular with draws kept constant on the feed side and/or on the outlet side of the rolling stand, and with the setting force for the working roll kept constant, is not always expedient. This means that if the offset is varied or iterated alone, it is not always possible for the calculated target horizontal force to satisfy the limit criterion. This leads to problems, in particular when using working rolls with a high slenderness ratio, particularly in conjunction with high strip draws, because these react particularly critically to excessive horizontal forces, for example with the aforementioned undesirable horizontal deflection.

The disclosure is based on the object of further improving a known method and a known computer program product for calculating a pass schedule for a stable rolling process during the rolling of, in particular, metallic material to be rolled in such a manner that the stability of the set of rolls in the rolling stand and thus the stability of the rolling process, in particular during the flat rolling of thin metallic strips as material to be rolled with high strength with the aid of thin working rolls is further improved.

This object is achieved with respect to the method by the method as claimed.

The term "setting data" refers to initialization or presetting data, as the case may be; such data are (pre)set on the rolling stand before the rolling process begins. Some of these can be changed later during the rolling process.

The "target horizontal force" calculated in accordance with the disclosure is a purely calculated variable that cannot be set directly on the rolling stand prior to the start of a rolling process. As mentioned, this is a resulting force resulting from the vectorial addition of, in particular, the feed draw, the outlet draw and the setting force of the working roll in the rolling stand. However, the "target horizontal force" serves as a representative variable on the basis of which the stability of a rolling process, in particular when using working rolls with a high slenderness ratio, can be predicted or determined, as the case may be, depending on whether or not it satisfies a predefined limit criterion that represents the stability of the rolling process. However, the resulting horizontal forces may be determined during the rolling process directly via load cells on the bending blocks (additional design effort) or indirectly via load cells, pressure measurements in the stand or the deflection rolls, along with torque measurements on the drive spindles indirectly (soft sensors) for the drive and operating sides of the stand.

The slenderness ratio, which is defined by the ratio of bearing center distance to working roll diameter, is a parameter that affects the stability of the rolling process, as described above. From a slenderness ratio of 5 or more, the risk of instability increases significantly.

The determination of the optimal draws on the material to be rolled on the feed side and/or on the outlet side of the rolling stand offers the advantage that the target horizontal force can still be kept within the limit criterion even if this is not possible by iterative variation of the offset alone.

Another advantage of the overall consideration of the target horizontal force is the minimization of the bearing load on the entire set of rolls, which significantly increases the service life of the roll bearings.

In accordance with a first exemplary embodiment, the calculation of the target horizontal force is performed separately or individually, as the case may be, for different sections k of the metal strip to be rolled, because the metal strip has different speeds in such different sections and experiences different strip draws.

In accordance with a second exemplary embodiment, a limit criterion for the horizontal stability of the rolling process, in particular for the working roll, is defined as a limit criterion, according to which 1. the at least two calculated target horizontal forces for the different sections of the metal strip must have the same sign; and/or
2. the calculated target horizontal forces do not exceed the predefined load limits dependent on the material for the working roll.

In accordance with a third exemplary embodiment, the calculated target horizontal force can still be kept within the limit criterion, even if this cannot be achieved by varying the offset and the draws on the feed side and/or on the outlet side of the rolling stand alone. For this purpose, this third exemplary embodiment provides that then, in addition, the setting force for the working roll is also varied with the optimal offset kept constant in each case and the optimal draws kept constant in each case, and also with the entry input data otherwise kept constant, until it is determined that the last calculated target horizontal force satisfies the limit criterion.

In accordance with another exemplary embodiment, the input data for the pass schedule calculator also comprises in particular data on technological limits. This also includes in particular load limits dependent on the material for the horizontal stability of the set of rolls of the rolling stand, limit values including the sign for the horizontal forces, limit values for the force and work requirement, limit values for the position of the nonslip point, limit values for the lead and for the torques of the rolls of the rolling stand. The specified load limits dependent on the roll material for the horizontal stability of the set of rolls and in particular of the working rolls should be taken into account, in particular when calculating the target horizontal force on the working roll, the target horizontal position of the working roll, the target draw of the material to be rolled at the feed and/or outlet of the rolling stand, and when calculating the target reduction for at least one pass of the rolling stand.

The consideration of the load limits dependent on the roll material in the calculation of the specified target setting data offers the advantage that the stability of the set of rolls, which in addition to the working rolls also comprises any intermediate and support rolls of the rolling stand, and thus also the stability of the rolling process as a whole is improved. This means that any undesired running of the strip to the right or left at the outlet of the rolling stand, strip cracks, roll kissing and buckling or bending of the rolls is avoided or at least minimized. By taking into account the load limits dependent on the material, it is also possible to roll thin thicknesses of the material to be rolled desired by customers while at the same time achieving very high strength values on conventional 4-Hi, 6-Hi rolling stands, multiple rolling stands or even on rolling stands with an odd number of rolls, even asymmetrically, without having to provide additional mechanical or fluidic assemblies to support the rolls on the rolling stand.

The stable boundary conditions made possible by the method can advantageously be predetermined for the rolling process and ensured by presetting the specified (target) setting data on the rolling stand even prior to the start of the rolling process. In this manner, the automatic threading and unthreading of the material to be rolled into and out, as the case may be, of the rolling stand can also be stably ensured without additional equipment. During the ongoing rolling process, the method enables the permanent monitoring of the specified target setting data and, if necessary, their correction in order to ensure the stability of the rolling process during ongoing operation as well. Through the method, the product range of an existing rolling mill can be extended, for example to the rolling of thinner final thicknesses, irrespective of its number of rolls and configuration. In addition, smaller working rolls can be used for such rolling stands in order to roll the specified thinner final thicknesses and to save energy at the same time.

In accordance with a further exemplary embodiment, the method is not only used for a single rolling stand, but also in a rolling mill in which a plurality of rolling stands are arranged one behind the other in the form of a rolling train. The specified target setting data can be calculated and set not only for a single rolling stand, but also for the specified pass schedule of a rolling train, that is, preferably for all its rolling stands, taking into account the load limits dependent on the material.

In accordance with a further exemplary embodiment of the invention, the actual horizontal force on the working roll is permanently monitored during the rolling process and controlled to a target horizontal force currently calculated by the pass schedule calculator. The horizontal force is controlled by suitable variations of actuators available on the rolling stand, such as the horizontal offset of the working rolls, the draw of the material to be rolled on the feed side and/or on the outlet side of the rolling stand and/or the thickness reduction (setting force) applied to the material to be rolled by the rolling stand.

A further improvement in the stability of the rolling process can be achieved by additionally taking into account production planning data, such as data concerning the optimization of the rolling program, data from production planning, plant planning and equipment utilization, when calculating the target setting data.

The measurement data obtained during monitoring of the current rolling process, such as the actual horizontal force, the actual horizontal position of the working rolls, the actual draw on the rolling stand at the feed and/or outlet of the rolling stand and/or the actual thickness reduction of the material to be rolled by the rolling stand, are preferably compared with the respective current target setting data. Any deviations between target and actual values detected in this manner can be used for a preferably continuous adaptation of the process model.

Further advantages for embodiments of the method are the subject of the dependent claims.

The object set forth above is further achieved by a computer program product. The advantages of this computer program product correspond to the advantages mentioned above with reference to the claimed method.

DETAILED DESCRIPTION

The invention is described in detail below with reference in particular to FIGS. 1-5 in the form of exemplary embodiments. In all figures, the same technical elements are designated with the same reference signs.

Figure 1:
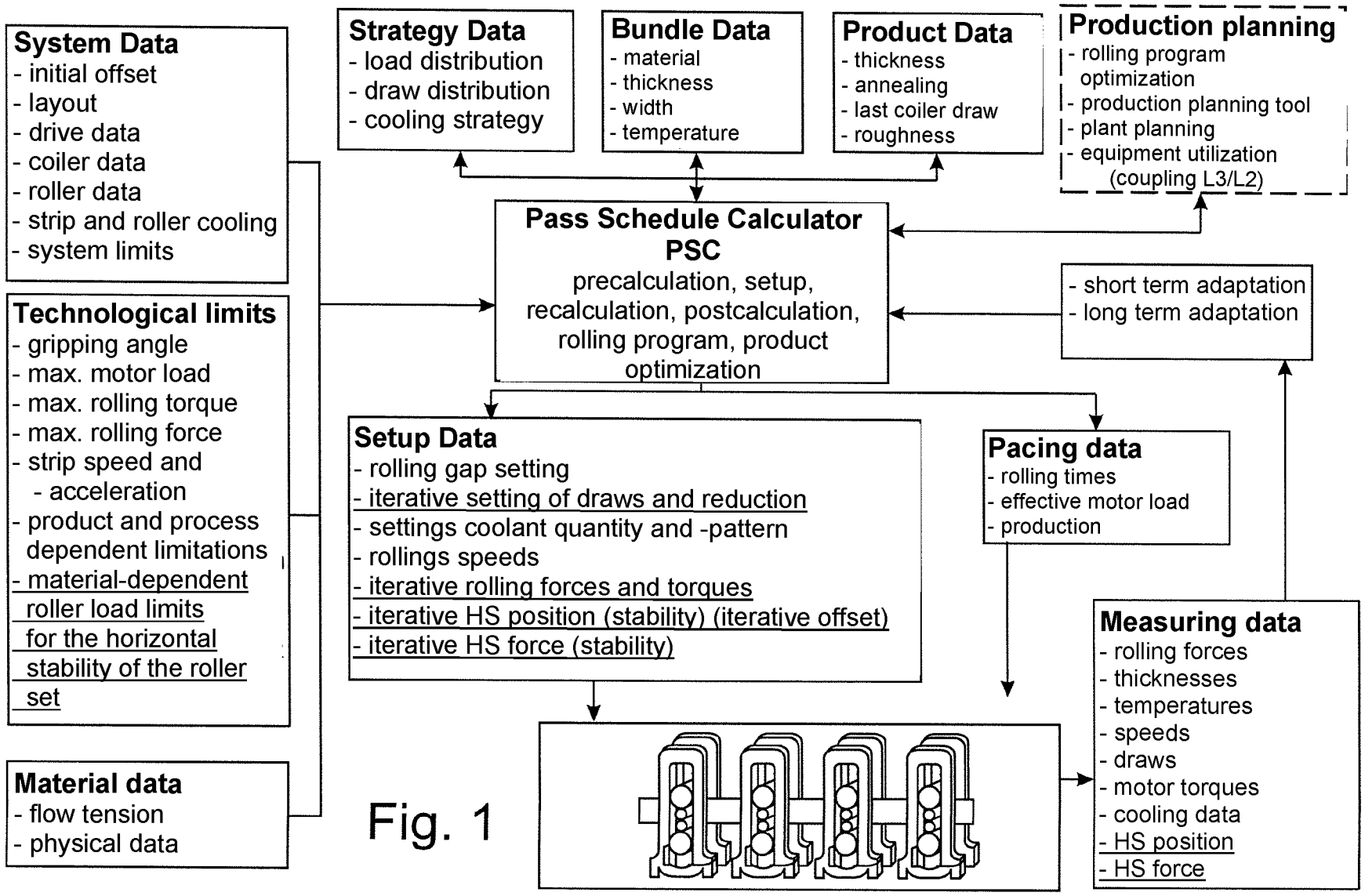
FIG. 1 illustrates the overall system of the pass schedule calculator with its input data and output data, where in the input data and output data relevant to the invention are underlined.

FIG. 1 illustrates the sequence of the complex calculation of a pass schedule for at least one rolling stand in accordance with the method. The core component for controlling a rolling process for material to be rolled with the aid of at least one rolling stand is a so-called "pass schedule calculator" on which a process model of the rolling process runs. The process model represents the complex forming process in the roll gap with the aid of known basic equations from forming technology and the condition of the set of rolls. In addition to the working rolls that span the roll gap of the material to be rolled, the set of rolls can also comprise intermediate and/or support rolls of the rolling stand. By running the process model on the pass schedule calculator, it is possible to perform advance calculations for the next material to be rolled after the current material to be rolled, recalculations concerning the current material to be rolled or superimposed product optimizations. To be able to calculate a pass schedule, the pass schedule calculator is fed input data that must be stored in a suitable manner, e.g. in databases or in parameter files, so that the pass schedule calculator can access them. For example, the rolling stand or the multi-stand rolling mill, as the case may be, must be described via system data as input data. In addition, the rolling process is subject to technological limits that must be strictly adhered to. In addition, the forming behavior of the material to be rolled must be mathematically described via its material data.

Furthermore, the material to be rolled must be defined via product data. In addition, so-called "bundle data" and the rolling strategy via strategy data must each be predefined as input data. In addition, production planning data can also be taken into account for consideration of higher-level targets, such as equipment utilization or rolling program optimization. All mentioned terms for the input data are collective terms for different individual data, which are shown in FIG. 1.

On the basis of such input data and on the basis of boundary conditions, the pass schedule calculator then calculates so-called "setup data," hereinafter referred to as target or initialization data, as the case may be, for a rolling process to be carried out next and sends such data to the at least one rolling stand for presetting.

Figure 8:
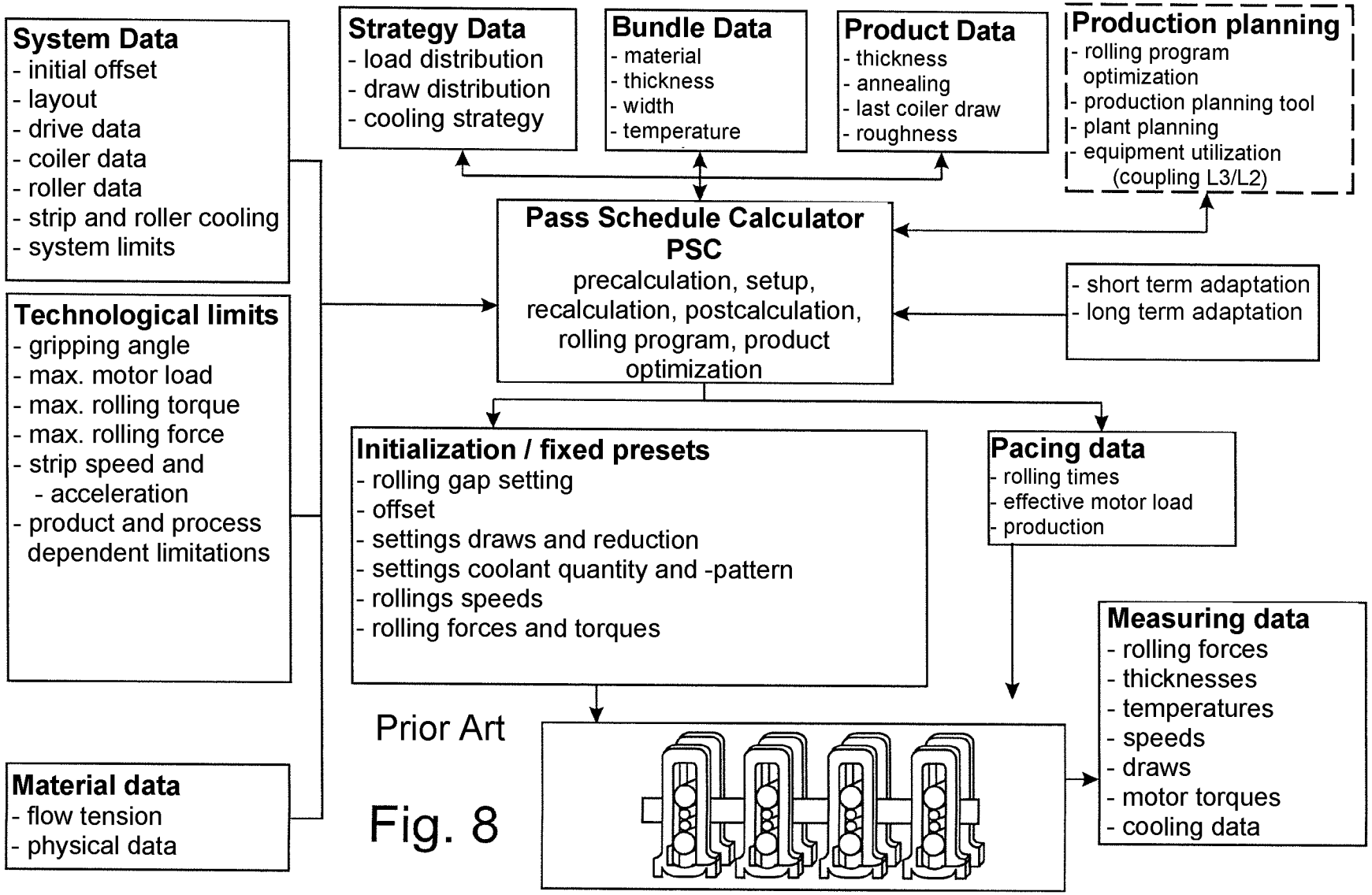
Prior Art Fig. 8
FIG. 8 illustrates the complete system of the pass schedule calculator with its input data and output data in accordance with the prior art.

In contrast to FIG. 8, which shows the pass schedule calculation in accordance with the prior art, the data in accordance with the invention for the technological limits shown in FIG. 1 comprise both roll load limits dependent on the material for the horizontal stability of the set of rolls and process technological limits, such as an impermissible change of sign of the horizontal force during different rolling phases of a pass schedule. Another difference to the prior art is that the HS (horizontal stability) position, that is, the offset of the working roll to the other roll supporting it in the rolling stand, and/or the HS force, that is, the horizontal force are determined, preferably measured, during an ongoing rolling process and are used in particular for an adaptation of the process model.

The most important difference to the prior art is that at least some of the setup data (underlined in the "Setup data" block in FIG. 1) are not only predefined once for the entire rolling process, but are determined iteratively with a view to achieving the highest possible stability of the rolling process. This means that the horizontal stability of the set of rolls, in particular the calculation of the horizontal forces on the working roll, is integrated into the pass schedule calculation.

The use of this such, which differs from the prior art, within the framework of the invention is described in more detail below.

Figure 2:
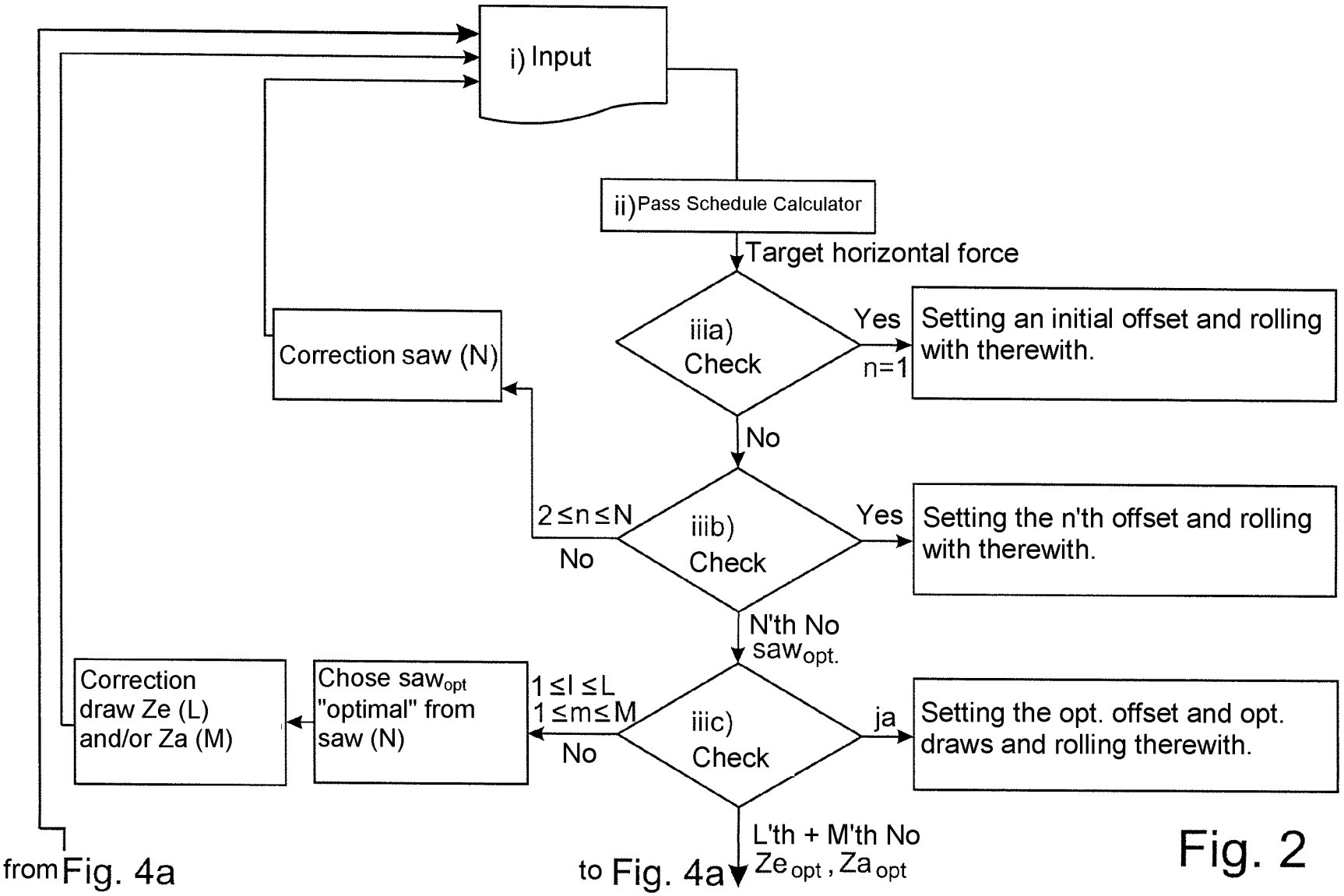
FIG. 2 illustrates a flow chart for the method for calculating the target horizontal force in accordance with a first exemplary embodiment.
Figure 7:
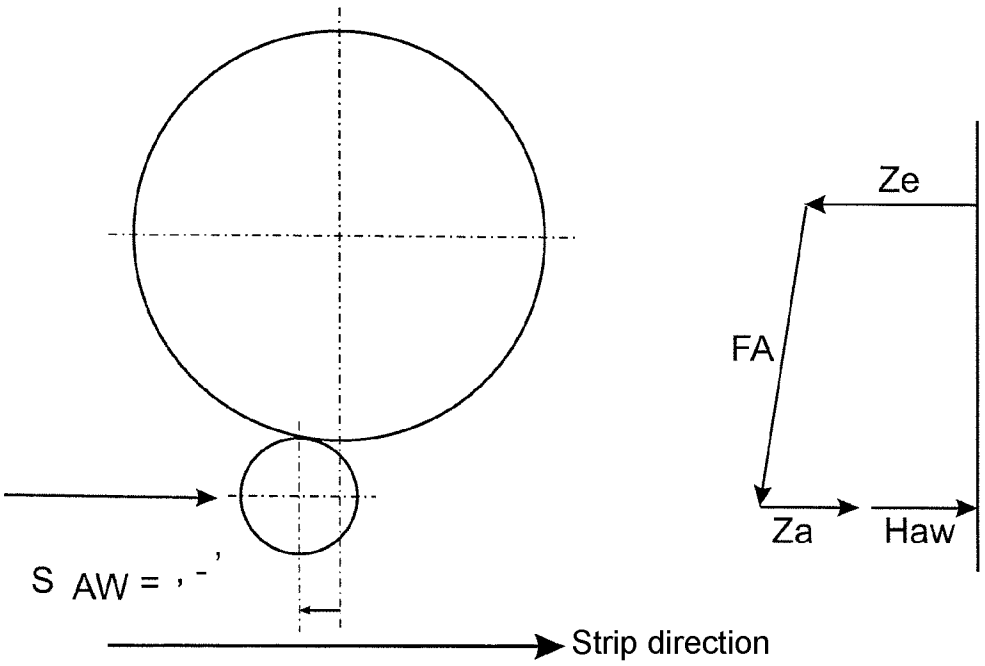
Fig. 7 Prior Art
FIG. 7 illustrates the offset of the working roll relative to an intermediate or support roll supporting it in the rolling stand, along with an associated parallelogram of forces (prior art).

FIG. 2 shows schematically the sequence of the method. Within the framework of the method, in a first iteration in a first method step i), the input data for the pass schedule calculator are provided, as previously described with reference to FIG. 1. Such input data also includes an initial offset saw of the working roll with respect to another roll supporting the working roll in the rolling stand. The initial offset can be determined either from a table or a database, but it is preferable to determine it from the formula known from FIG. 7, in which case the strip draws Ze and Za are set to zero. Prior to and/or during the rolling process, the method then provides that, in a second step ii), the target horizontal force on the working roll is calculated with the aid of the pass schedule calculator. For this purpose, a process model of the rolling process runs on the pass schedule calculator and the pass schedule calculator calculates the target horizontal force taking into account the input data.

In a subsequent third method step iii), the target horizontal force previously determined by the pass schedule calculator with the initial offset is checked to determine whether it satisfies a predefined limit criterion. Such limit criterion represents the horizontal stability of the rolling process, in particular that of the working rolls. Such limit criterion is defined in such a manner that 1. the at least two calculated horizontal forces for different sections of the metal strip must have the same sign and/or
2. the calculated target horizontal forces do not exceed the predefined load limits for the working rolls dependent on the material.

In the event that the determined target horizontal force satisfies the limit criterion, the method provides that the (optimal) offset $saw_{opt}$ on which the calculation of the target horizontal force was based, that is, in this case the initial offset, is set on the rolling stand and that the material to be rolled or the metal strip, as the case may be, is then rolled with the specified initial optimal offset. On the basis of the set optimal offset, it can be assumed that rolling then also takes place with the calculated target horizontal force, which satisfies the limit criterion.

Otherwise, that is, if the target horizontal force calculated with the initial offset does not satisfy the limit criterion, the method provides for steps i), ii) and iii) to be repeated in a further maximum of N iteration steps, in each case with a corrected/changed offset saw of the working roll from a set of N available different offsets, but otherwise with unchanged input data, until it is finally determined in step iii) that the last calculated target horizontal force satisfies the limit criterion, taking into account the last changed or set optimal offset.

In the event that the calculated target horizontal force should not satisfy the limit criterion for any of the available N offsets, the method provides that steps i), ii) and iii) are carried out in further maximum L and/or M iteration steps with a respectively changed draw Ze on the material to be rolled on the feed side of the rolling stand from a set of $L \in \mathbb{N}$ available different draws on the feed side and/or with a respectively changed draw Za on the material to be rolled on the outlet side of the rolling stand from a set of $M \in \mathbb{N}$ available different draws on the outlet side of the rolling stand and with the optimal offset $saw_{opt}$ kept constant in each case and are repeated with input data also otherwise unchanged, until it is finally determined in step iii) that the last calculated target horizontal force, taking into account the last changed optimal draw, satisfies the limit criterion. The specified optimal offset is the offset for which the calculated target horizontal force most closely satisfies the limit criterion in the previously performed iteration of the offset.

FIG. 2 shows this method, wherein the abbreviation "saw" stands for the offset of the working roll, the abbreviation "Ze" for the strip draw on the feed side of the rolling stand and the abbreviation "Za" for the strip draw on the outlet side of the rolling stand.

The target horizontal force is not calculated uniformly for an entire metal strip, but individually for different sections of the metal strip. This is useful, because the speed at which the metal strip to be rolled passes through the rolling stand and the accelerations and friction conditions exerted on the metal strip for a feed section of the metal strip, with which the metal strip is threaded into the rolling stand or its roll gap, as the case may be, are different from the speed, acceleration and friction conditions of the metal strip during the rolling of the middle part (fillet) of the metal strip and during the rolling of the outlet section, when the metal strip is decelerated. In addition to the speed, acceleration and friction conditions, the strip draw exerted on the metal strip sections of the metal strip are also different.

Figure 3:
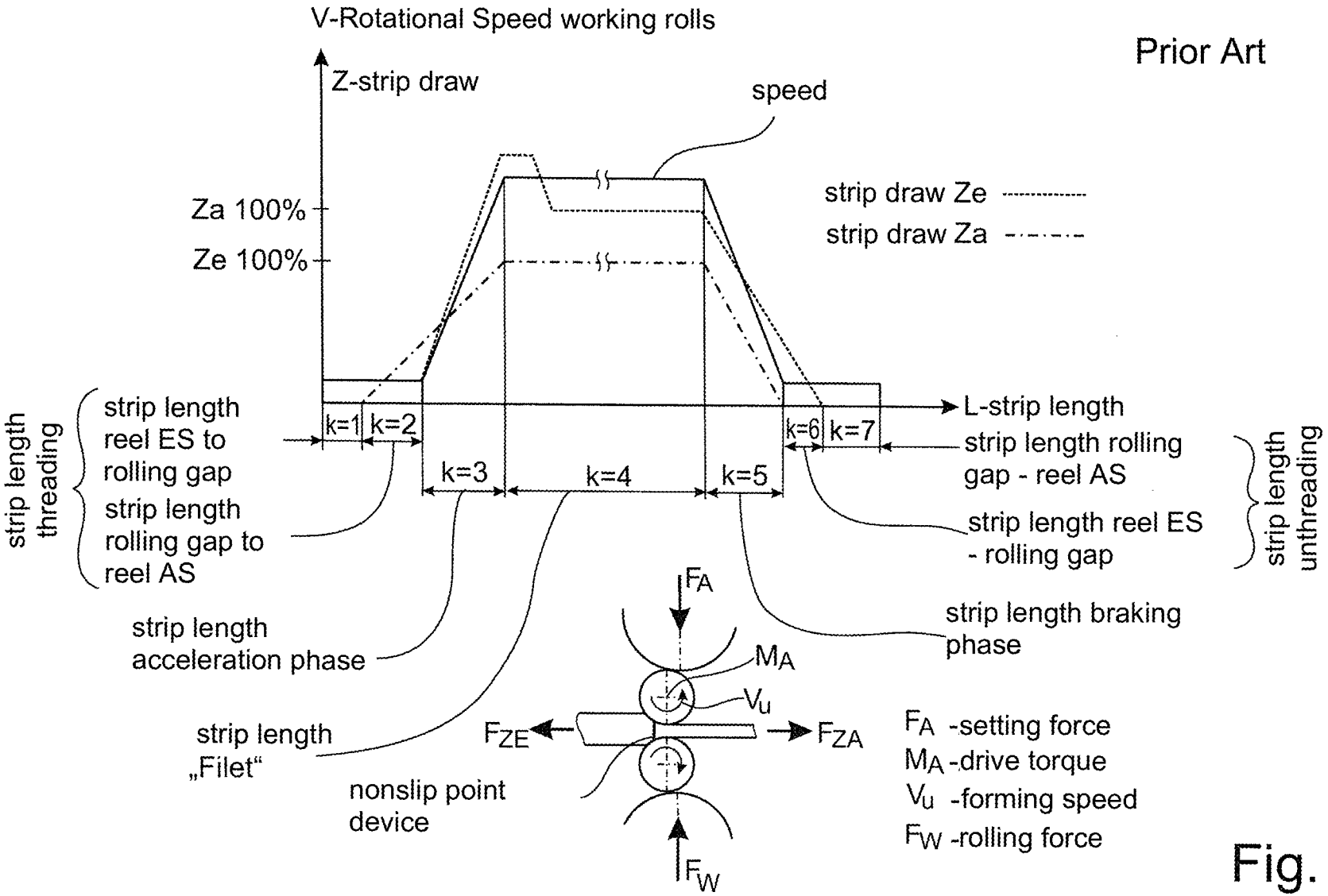
FIG. 3 illustrates technological relationships and differences in the feed and outlet of a metal strip to be rolled into a rolling stand (prior art).

FIG. 3 illustrates these technological relationships, which are generally known in the prior art.

This problem is addressed by the present invention in that, as stated, the target horizontal force is calculated individually for each section $k \in N$ of the metal strip. With metal strip, a distinction is made in particular between a feed section with k=1, a center section (fillet) with k=4 and an outlet section with k=7. The target horizontal forces for at least two of these sections are individually calculated in the form of the horizontal force Haw einl on the working roll when threading the material to be rolled with its feed section k=1 into the roll gap of the rolling stand, in the form of the horizontal force Haw filet on the working roll when rolling the fillet of the material to be rolled k=4 and/or in the form of the horizontal force Haw ausl when threading the material to be rolled with its outlet section k=7 out of the rolling stand, by individually going through steps i), ii) and iii) in accordance with FIG. 2 for calculating each of the target horizontal forces in the individual sections of the metal strip.

Figure 4A:
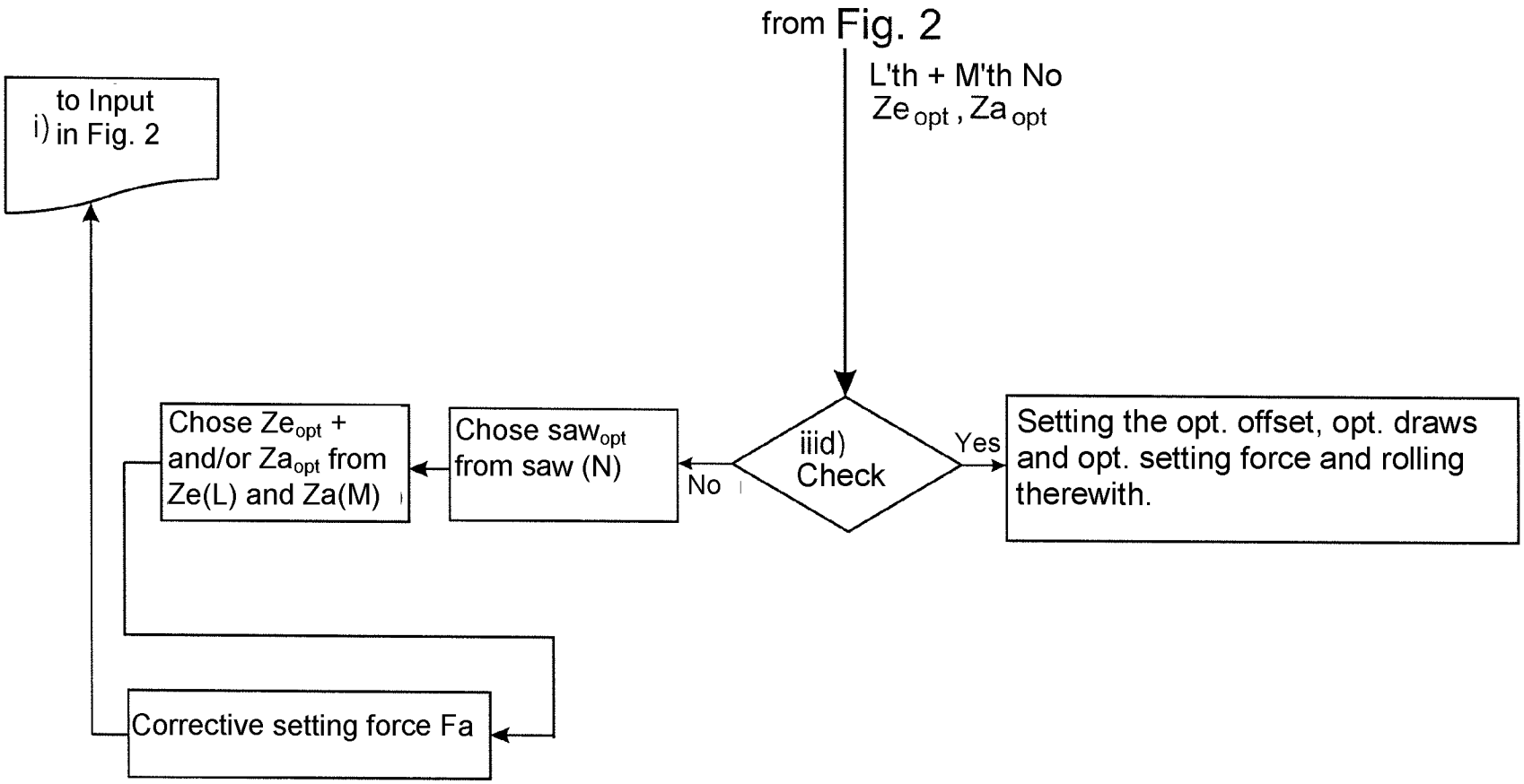
FIGS. 4*a*, 4*b* illustrates a flow chart for the method for calculating the target horizontal force in accordance with a second exemplary embodiment of the invention.

FIG. 4*a*) illustrates a further exemplary embodiment of the method in the case where the calculated target horizontal force does not lead to the respective calculated target horizontal force satisfying the limit criterion, neither in the case of a sole iterative change of the offset, nor in the case of a sole iterative change of the strip draw Ze on the feed side of the rolling stand, nor in the case of a sole change of the strip draw Za on the outlet side of the metal strip. For this case, the method provides that, first of all, those optimal draws from the set of L available different draws on the feed side and/or from the set of M available different draws on the outlet side of the rolling stand, with which the calculated target horizontal forces best satisfy the limit criterion with the optimal offset kept constant and otherwise constant input data as well. With the optimal offset and the optimal draws selected in this manner, the method steps i), ii) and iii) are then repeated, in each case with iteratively changed setting forces FA h from a set of H available setting forces with h=1 . . . H, until it is established in method step iii) that the last calculated target horizontal force satisfies the limit criterion. The optimal values determined in this manner for the offset, for the strip draws on the feed side and outlet side of the rolling stand, and for the setting force are then set on the rolling stand before and during a rolling operation. Given that the calculation of the optimal values for the individual sections of the metal strip is carried out individually, the calculated optimal parameters are also reset individually during a rolling operation, depending on which section of the metal strip is currently being rolled.

Unlike the optimal parameters determined iteratively in accordance with the method, the calculated target horizontal force cannot be preset directly on the rolling stand. Rather, it is a resulting variable that is automatically set and produced when the specified parameters are set on the rolling stand. If the optimal values for the specified parameters are set, it may be trusted that the target horizontal force will satisfy the limit criterion and that therefore the process will be stable.

If the metal strip to be rolled passes not only through one rolling stand, but through a rolling mill with a plurality of rolling stands arranged one behind the other in the rolling direction, the target horizontal force for the working rolls is determined individually in the individual stands within the framework of the pass schedule calculation, and the associated iteratively determined optimal parameters for a pass sequence are preset or set individually, as the case may be, at the working rolls of the rolling stands.

It has already been mentioned above with reference to FIGS. 1 and 8 that technological limits are also fed to the pass schedule calculator as input. These also comprise in particular load limits dependent on the material for the horizontal stability of the roll neck of the rolling stand, limit values, including signs, for the horizontal forces and limit values for the force and work requirement, limit values for the position of the nonslip point, limit values for the lead and for torques of drives, e.g. for the rolls of the rolling stand.

The calculation of the HS offset to be set, taking into account the permissible horizontal forces, can be carried out as follows, see FIG. 4*b*):

For a planned rolling pass from an entry thickness of 2.0 to 0.793 mm with a strip width of 1162 mm and a working roll diameter of 330 mm, the strip draws Ze, Za specific to the pass schedule are initially determined. In addition, the resulting setting forces FA, but especially the horizontal forces Haw Einfädeln, Haw Filet, Haw Ausfädeln for the threading and unthreading phases k=1, k=7, along with the rolling phase k=4 of the strip fillets are calculated with regard to different possible settable offset positions saw. System-specific and forming parameters are taken into account for setting an optimal offset position.

The calculation shows that, for a constant setting force (FA), constant draws (Ze/Za) and different offset positions saw, the horizontal forces Haw change. However, the horizontal forces Haw in the various rolling phases k or the total resulting horizontal force Fres must be decided. If the horizontal force Haw in the rolling phases k=1, k=4, k=7 or Fres exceeds the permissible limit values, specified by the 2nd limit criterion, it can lead to damage to the roll or process instabilities (unflatness, undesirable hysteresis) and thus to a loss of production. The permissible values are calculated as shown in FIG. 4*a*).

If the offset position leads to a change of sign (1st limit criterion) between the sections of the metal strip, this can subsequently lead to an undefined unstable rolling situation, which not only results in poor flatness values, but also causes the rolls to move freely, which can damage the roll and its bearings, along with the adjacent rolls. In addition, the alternating setting of the working rolls or adjacent rolls is a serious problem with regard to the strip run. The strip is driven sideways out of the roll gap. Diagonal waves or even strip tears are the result. If the horizontal forces are too low, the tendency of the stand to vibrate increases and quality tolerances cannot be maintained. If the horizontal forces are too large, the dynamics of the control of the hydraulic adjustment will be negatively influenced by increased hysteresis.

Figure 4B:
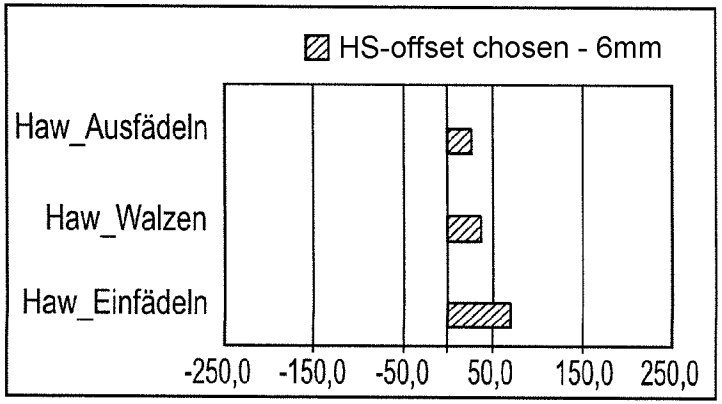
Figure 4B:
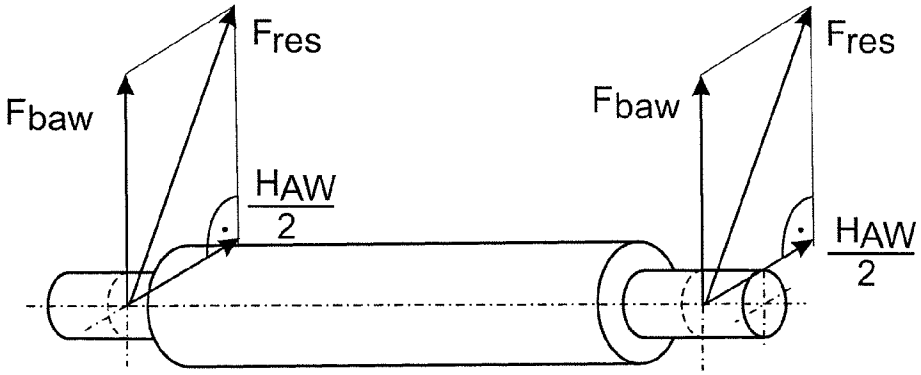

In the sample calculation in accordance with FIG. 4*b*, it becomes clear that, for the two offset positions saw of −8 and −6, no sign changes occur in the associated calculated horizontal forces Haw in the 3 strip sections k=1, k=4, k=7, but that, for the offset position of saw=−8, the associated horizontal force on the working roll Haw with Fbaw with a value of 84.3 kN is minimally above the permissible limit value of the load limit dependent on the material in the amount of 80 kN as an example here.

For the determination of the load and its limit consideration, both the resulting horizontal force HAW/2 and the maximum bending force FaBW are taken into account and compared as Fres—resulting total force with the permissible limit criterion.

Since all conditions are positively satisfied with an offset saw of −6, an optimal offset of −6 mm is set for this rolling pass in the example shown in FIG. 4*b*.

If the calculation of the horizontal loads and the possible offset positions from the quantity N does not result in a permissible setting, it is necessary to adjust the pass schedule automatically, as described above with reference to FIGS. 2 and 4*a*. It is possible to adjust the strip draws, the pass reduction, the rolling forces or the setting forces, as the case may be, and, to a limited extent, even the working roll diameters (e.g., rolling with a new or ground-down roll). The resulting values from the pass schedule calculation are automatically compared with those from the horizontal load calculation until stable conditions are obtained.

Figure 5:
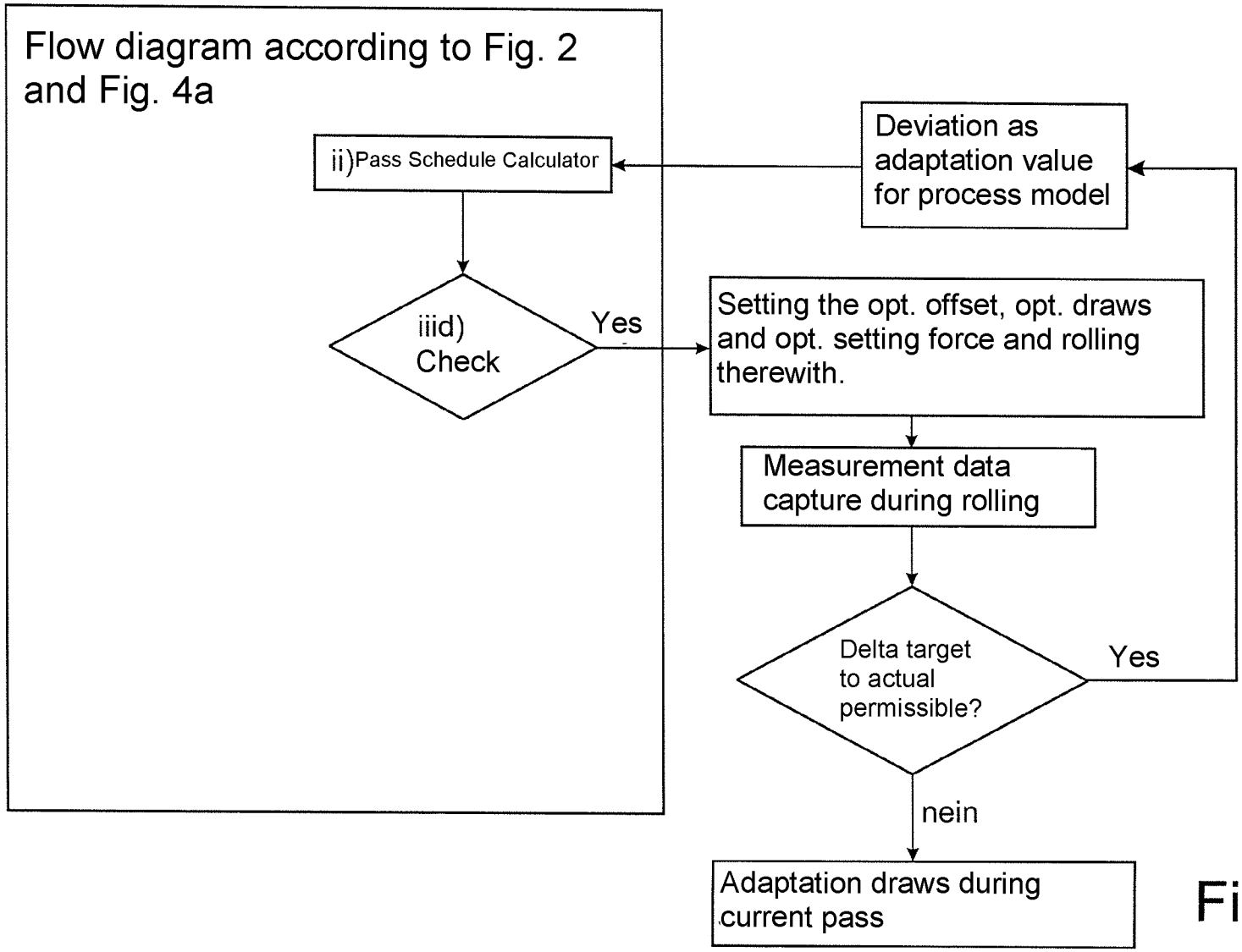
FIG. 5 illustrates a flow chart for the method with an additional adaptation of the process model.
Figure 6:
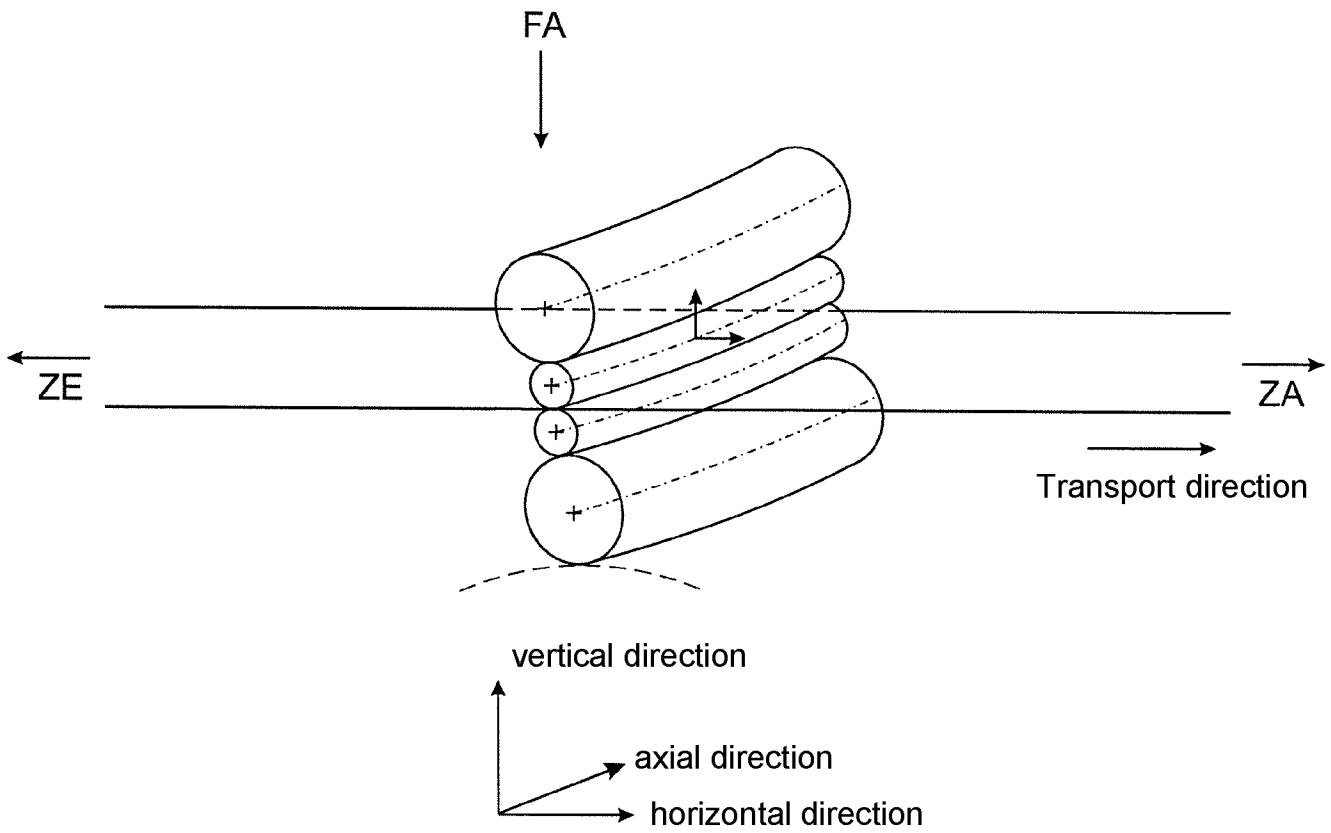
Fig. 6 Prior Art
FIG. 6 illustrates the undesirable horizontal deflection of working rolls with a high slenderness ratio (prior art).

FIG. 5 shows a further aspect of the method. This provides that, as already shown in FIG. 1, the running rolling process is permanently monitored in that various measurement data, in particular the at least one actual horizontal force and/or the actual horizontal position (=offset) of at least one of the working rolls are recorded, preferably cyclically, and that the actual horizontal force determined in this manner is compared with a respective current target horizontal force and/or that the actual horizontal position is compared with the respective current target horizontal position of the working roll. This comparison consists in particular of the formation of a difference. Any deviations (delta) between the target and actual values detected in this manner are then checked to determine whether they lie within predefined permissible ranges. If permissibility is present, the deviations are used for a preferably continuous adaptation of the process model running on the pass schedule calculator. This makes the process self-learning. If the permissibility of the deviations (delta) between the target and actual values is not present, the strip draws are adjusted during the current pass such that the determined deviations become permissible again if possible.

The measurement data can also comprise, for example: rolling forces exerted by the at least one rolling stand on the material to be rolled, the thickness of the material to be rolled, the temperature of the material to be rolled, the rolling speed, the offset of the working rolls, the tensile load on the material to be rolled, motor torques of drives allocated to the rolling stand, e.g. for setting or rotating the rolls, and/or cooling data, which represent, for example, the cooling of the material to be rolled.

At least one, preferably both, of the working rolls of the rolling stand are driven.

The rolling stand can be designed as a reversing stand, wherein the material to be rolled is therein rolled in reversing operation with the aid of the rolling stand.

Additional measures improving the invention:

The invention can be used equally well for single stands and tandem rolling trains, along with one-way and reversing operation. It is suitable for 4 Hi and 6Hi along with j-Hi (j=2 to 6) rolling stands.

A well-known HS displacement system is used to set the displacement position saw. This is structurally located in the region of the roll chocks and is fastened to the rolling stands. Thus, there is no need to provide any additional mechanical equipment along the roller body. This region remains free for effective roll cooling/lubrication, inductors, brushes and strip guiding elements.

Utilization of the permissible and possible drive torque of a small working roll can be achieved by using HT (high torque) spindles with torque or temperature monitoring.

A working roll twin drive reduces the possible torque distortion between the two working rolls and can thus also be used as a further measure to reduce the resulting horizontal force or to further reduce the roll diameters.

The automatic pass schedule calculation/generation with the integrated calculation of horizontal forces is associated with different levels of automation.

The basic automation (level 0, level 1) ensures that the calculated target values are mandatorily set. If the target values are not set (comparison of target value and actual measured value), a feed stop is issued.

The pass schedule calculation and the integrated calculation of horizontal forces are part of a physical process model (Level 2) or a subset (sub-models Level 2).

The models and/or the pass schedule calculation with the associated calculation of horizontal forces may have a superimposed optimization algorithm. The optimization can be self-learning or via adaptation and, if necessary, take into account existing measured values.

A connection with a production planning tool (Level 2½ or Level 3) can be provided. In this manner, pass sequences that cannot be produced in a technically stable manner can still be produced by a different production route without causing problems on the rolling mill itself. Alternatively, by linking to a production planning tool of the product to be manufactured, adjustments can be made to avoid downtime at the plant.

A combination with automatic maintenance planning (Level 2½ or Level 3) can be provided in order to achieve fine adjustment with the working roll diameters used.

The predicted resulting horizontal forces are compared with measured horizontal forces. Force measuring devices (e.g., piezo elements, pressure measurements, strain gauges or load cells) can be provided in the region of the bending devices for the measurement. Alternatively, the measurement can be calculated back indirectly via digital soft sensors using measurable parameters involved.

An alignment of calculation and measurement values of the horizontal forces can be achieved by learning algorithms as part of the process models or a sub-model, such that an adaptation (long-term/short-term adaptation) of the model-based calculations can take place.

The invention claimed is:

1. A method for calculating a pass schedule for a stable rolling process in rolling at least a section of a metal strip in a rolling stand, comprising the following steps:

i) providing input data to a pass schedule calculator, wherein the input data includes a predefined initial offset of a working roll relative to another roll in the rolling stand; and prior to and/or during the rolling process:

ii) calculating a target horizontal force on the working roll by the pass schedule calculator running a process model of rolling, taking into account the input data; and iii) checking whether the target horizontal force calculated by the pass schedule calculator satisfies a predefined limit criterion;

in response to determining that the target horizontal force satisfies the predefined limit criterion, setting the offset, on which the calculation of the target horizontal force was based, on the working roll and rolling the metal strip with the target horizontal force; or in response to determining that the target horizontal force does not satisfy the predefined limit criterion, repeating steps i), ii) and iii) with a changed offset (saw) of the working roll from a set of N available different offsets and with otherwise unchanged input data until it is determined in step iii) that the last calculated target horizontal force, taking into account the last changed offset, satisfies the limit criterion;

upon determining that iterative repetition of steps i), ii) and iii), each with a change in the offset alone, does not result in the target horizontal force satisfying the limit criterion in step iii), applying the following a first modification:

selecting an optimal offset from the set of N offsets with which the calculated target horizontal force best satisfies the limit criterion, and repeating steps i), ii) and iii)

with a respectively changed draw on the metal strip on a feed side of the rolling stand from a set of L available different draws and/or with a respectively changed draw on the metal strip on an outlet side of the rolling stand from a set of M available different draws and with the optimal offset kept constant in each case and with otherwise unchanged input data, until it is determined in step iii) that the last calculated target horizontal force, taking into account the last changed draw, satisfies the limit criterion.

2. The method according to claim 1, wherein the metal strip has a plurality (k) of sections, including a feed section (k=1), a middle section being a fillet (k=2) and an outlet section (k=3); and the target horizontal forces for at least one of these sections are individually calculated in form of the horizontal force on the working roll when threading the metal strip with its feed section into a roll gap of the rolling stand, in form of the horizontal force on the working roll when rolling the fillet of the metal strip and/or in form of the horizontal force when unthreading the metal strip with its outlet section out of the rolling stand, by individually going through steps i), ii) and iii) for calculating each of the target horizontal forces in the individual sections of the metal strip.

3. The method according to claim 2, wherein a limit criterion for a horizontal stability of the rolling process is defined as a limit criterion, according to which 1) at least two calculated target horizontal forces for different sections of the metal strip must have the same sign; and/or 2) the calculated target horizontal forces do not exceed predefined load limits for the working roll dependent on a material.

4. The method according to claim 1, wherein, if the iterative repetition of steps i), ii) and iii) with the change made to the draws while keeping the optimal offset constant does not result in the calculated target horizontal force satisfying the limit criterion in step iii), the method provides for the following second modification with the "if no" option:

selecting those optimal draws from the set of L available different draws on the feed side and/or from the set of M available different draws on the outlet side with which the calculated target horizontal forces best satisfy the limit criterion with the optimal offset kept constant and with the input data otherwise kept constant;

repeating steps i), ii) and iii) with an iteratively changed setting force (FA) for the working roll in each case with the optimal offset and optimal draws kept constant in each case, and also with the input data otherwise kept constant, until it is determined in step iii) that the last calculated target horizontal force satisfies the limit criterion.

5. The method according to claim 1, wherein a plurality of rolling stands are arranged one behind the other in the rolling direction in a rolling mill;

wherein the target horizontal force is determined individually for a plurality of working rolls in the rolling stands arranged one behind the other; and wherein the allocated iteratively determined optimal parameters for a pass sequence are preset or set, as the case may be, on the working rolls of the rolling stands.

6. The method according to claim 1, wherein the input data are system data, data on technological limits, material data, data on rolling strategy, bundle data, product data and/or production planning data.

7. The method according to claim 6, wherein the data on technological limits have at least limit values for individual of the following parameters:

load limits dependent on the material for a horizontal stability of the set of rolls of the rolling stand, limit values, including signs for the horizontal forces, limit values for the force and work demand, limit values for a position of the nonslip point, limit values for a lead and for torques of drives.

8. The method according to claim 3, wherein measurement data, including at least one actual horizontal force and/or an actual horizontal position of at least one of the working rolls, are recorded during an ongoing rolling process; and the actual horizontal force is compared with the respective current target horizontal force and/or the actual horizontal position is compared with the respective current target horizontal position of the working roll.

9. The method according to claim 8, wherein any deviations between the target and actual values detected are checked to determine whether they lie within predefined permissible ranges; and if permissibility is present:

using the deviations for a continuous adaptation of the process model running on the pass schedule calculator.

10. The method according to claim 8, wherein the measurement data further comprise:

rolling forces exerted by the at least one rolling stand on the metal strip, a thickness of the metal strip, a temperature of the metal strip, a rolling speed, the offset of the working rolls, a tensile load on the metal strip, motor torques of drives allocated to the rolling stand, and/or cooling data, which represent, the cooling of the metal strip.

11. The method according to claim 1, wherein two rolls of the rolling stand are driven.

12. The method according to claim 1, wherein the rolling stand is designed as a reversing stand; and the metal strip is rolled in reversing operation by the rolling stand.

* * * * *